US005507222A

United States Patent [19]

Reavey

[11] Patent Number: 5,507,222

[45] Date of Patent: Apr. 16, 1996

[54] CAN CRUSHER

[76] Inventor: Oliver M. Reavey, 2 Stevens Lane, Breaston, Derby, DE72 3BU, United Kingdom

[21] Appl. No.: 383,244

[22] Filed: Feb. 3, 1995

[51] Int. Cl.[6] ..... B30B 7/00; B30B 9/32

[52] U.S. Cl. ..... 100/35; 100/233; 100/902

[58] Field of Search ..... 100/35, 233, 293, 100/902

[56] References Cited

U.S. PATENT DOCUMENTS

| | | | |
|---|---|---|---|
| 602,836 | 4/1898 | Dollfus | 100/233 |
| 1,402,433 | 1/1922 | Monroe | 100/233 |
| 2,614,604 | 10/1952 | Coffey | 100/902 |
| 2,800,160 | 7/1957 | Wilson et al. | 100/233 |
| 3,299,802 | 1/1967 | Black, Jr. | 100/902 |
| 3,667,386 | 6/1972 | Workman | 100/902 |
| 3,776,129 | 12/1973 | Carlson | 100/233 |
| 3,853,054 | 12/1974 | Jacobsen | 100/233 |
| 4,208,961 | 6/1980 | Okajima | 100/233 |
| 4,383,480 | 5/1983 | Jerden | 100/233 |
| 4,442,768 | 4/1984 | Bailey | 100/233 |
| 4,459,905 | 7/1984 | Wilson | 100/233 |
| 4,532,861 | 8/1985 | Gisselberg, III | 100/233 |
| 4,561,351 | 12/1985 | Ader | 100/233 |
| 4,606,266 | 8/1986 | Hyman, Sr. | 100/233 |
| 5,203,262 | 4/1993 | Menard et al. | 100/233 |

FOREIGN PATENT DOCUMENTS

| | | | |
|---|---|---|---|
| 2826207 | 12/1979 | Germany | 100/233 |
| 4402880 | 9/1994 | Germany | 100/902 |
| 1-218799 | 8/1989 | Japan | 100/902 |

*Primary Examiner*—Stephen F. Gerrity
*Attorney, Agent, or Firm*—Webb Ziesenheim; Bruening Logsdon; Orkin & Hanson

[57] ABSTRACT

A can crusher has a removable arm member hingedly connected to a base member, and the arm member has a crushing portion which is received in nested fashion by a can receiving portion on the base member. The crushing portion has a bearing wall with a lip and a plurality of struts perpendicular to the bearing wall. The lip extends above the struts. The base member has a step pad so that the can crusher may be either wall mounted or portable. The lip engages the rim on a container to be crushed to captively secure the container between the lip and the base member. This avoids accidental ejection of the container from the can crusher. When the arm member is in the open position, the lip is spaced from the base member a sufficient distance to accommodate aluminum beverage cans, steel cans and plastic bottles of common household sizes. The struts may also be provided with protective elements to prevent undue wear on the crushing portion. Thus, the invention provides a universal, portable, and effective can crusher which may be easily disassembled for cleaning and which may be made from lighter, cheaper materials while maintaining significant durability.

18 Claims, 9 Drawing Sheets

CAN CRUSHER

BACKGROUND OF THE INVENTION

1. Field of the Invention

This invention relates to crushing devices and, more particularly, to a hand-operated crushing device designed to crush aluminum beverage cans, steel cans, plastic bottles or the like.

2. Description of the Prior Art

A problem of current concern in the United States is the proliferation of aluminum beverage cans and other types of cans and bottles (collectively referred to herein as "cans" or "containers") in dumps and landfills. In their intact, empty form, these cans have a relatively large internal volume, and therefore, take up much needed space in overcrowded landfills. Numerous can crushing designs are known in the art to crush the cans prior to placing them in landfills or trash dumps. There are several problems associated with these crushing devices which are not adequately addressed by the prior art. Particularly, prior crushing devices have encountered problems with leaping cans, i.e., the devices eject the cans accidentally during crushing. This can be both dangerous and messy. There are insufficient means in these devices to capture the can in the device and prevent leaping. Further, the prior devices are often limited to crushing one type of can, to the exclusion of other types. There is an absence in the art of a universally applicable crushing device. Additionally, there is a need for a device which can be both wall and floor mounted. Users have differing preferences in this regard and a single device offering mounting choices would be desirable. Cleaning can also be a problem. Prior art devices are not easily adapted for adequate cleaning, such as by rinsing after each use or placing in a dishwasher. Metallic construction, multiple moving parts, and non-removable joints are all factors which complicate cleaning and hence reduce the useful life of the device. Finally, there remains a need in the art for a crushing device which is safe, effective, adaptable, lightweight, easy to clean and yet inexpensive. However, many inexpensive, light materials from which cheaper crushing devices might be constructed are subject to deformation and marring by the can during the crushing operation. It is also desirable to manufacture crushing devices, such as by injection or extrusion molding, with somewhat flexible material to provide removable snap-fitting parts. These flexible materials are also subject to damage while crushing.

U.S. Pat. No. 5,265,530 to Perhacs et al. discloses a wall mounted plastic bottle and can crusher having a base member and a pivotally movable arm member. The base member includes a pair of brackets, each having a hinge pin for hingedly engaging the arm member. The base member is provided with screw holes for mounting the base member to a wall. A plastic bottle or aluminum beverage can is placed in the device and crushed between two arc-shaped crushing surfaces by forcing the arm member toward the base member. This device is not portable and is only suitable for use when mounted to a wall or similar surface. Furthermore, the device is apparently limited to crushing only aluminum beverage cans or plastic bottles. Enlarging recesses 16 and 24 to accommodate both aluminum beverage cans and cans of larger diameter would likely result in a leaping can problem respecting cans of smaller diameter. Nor does this patent disclose removable arm and base members, so that thorough cleaning may be difficult.

U.S. Pat. No. 5,188,024 to Li discloses a can crusher having a crushing assembly with several moving parts which includes a squeezing chamber in the base of the can crusher and a ratchet and pawl assembly for crushing aluminum beverage cans between a piston member and a compression end plate. This device appears unduly complicated and expensive to manufacture. Furthermore, it does not appear the device is suitable for disassembly and cleaning. Finally, the device is substantially limited to crushing one size can as the piston member apparently must have a diameter coincident with the diameter of the can to be crushed. The disclosure is limited to crushing aluminum beverage cans.

Other examples of can crushing devices are set forth in U.S. Pat. Nos. 5,293,816; 5,158,013; 5,138,941; 5,038,677; and 5,009,155.

Therefore, it is an object of the present invention to provide a can crusher which avoids accidental ejection of the can, is simple to disassemble for cleaning and reassemble for use, is lightweight, easy to operate, adapted to crush various types of cans and bottles, able to be wall mounted or portably used on a floor or other flat surface, has a low cost of manufacturing, and can be made from cheaper and/or more flexible materials while not subject to undue wear during the crushing operation. Furthermore, it is an object to embody all the above advantages in one single crushing device.

SUMMARY OF THE INVENTION

Accordingly, I have invented a crushing device having a base member with a pair of side walls, a first end wall, a second end wall and a base wall defining a container receiving portion. The second end wall has a journal element spaced from the base wall. A removable arm member is hingedly connected to the base member, and the arm member has a handle, a crushing portion and a spindle. The spindle is received in the journal elements on the base member so that the crushing portion faces the container receiving portion and the crushing portion may be engaged in the container receiving portion in nested fashion. A step pad extends from the second end wall on the base member.

The arm member crushing portion has a bearing wall separating an upper crushing portion and a lower crushing portion. The lower crushing portion has a plurality of struts perpendicular to the bearing wall and extending in the general longitudinal direction of the arm member. Each strut has a first end adjacent the spindle and a second end adjacent the bearing wall. The bearing wall has a lip extending above the second ends of the struts. The lip captures a container between the arm member and the base member, without ejecting the container so that the container is crushed when the crushing portion of the arm member is engaged in the container receiving portion of the base member.

Preferably, the crushing device includes a protective element on at least one of the struts positioned between the first and second ends of the strut. The preferred embodiment also includes use instructive indicia on the step pad, means for securing the base member to a flat surface, such as a wall, an emblem insert on the arm member, a stabilizer extending from the first end wall of the base member, a plurality of raised ribs on the base member base wall and at least one drain opening in the base member for rinsing the base member after use.

I have also invented a method for crushing a container having a first end and a second end, with a rim on the second end, in a device as generally described above. The method includes the steps of:

1) placing the base member on a flat surface;

2) pivoting the arm member so that the arm member is disposed at an angle with respect to the base member to provide clearance between the arm member and the base member for a container to be crushed;

3) placing the container in the container receiving portion of the base member so that the first end of the container is adjacent the first end wall and the second end of the container is adjacent the second end wall;

4) applying pressure to the step pad by stepping with a foot or pressing with a hand;

5) pivoting the arm member to engage the rim of the container on the bearing wall;

6) further pivoting the arm member in the direction of the base member to engage the crushing portion in the container receiving portion in nesting fashion and crush the container; and 7) pivoting the arm member out of nesting engagement with the base member to remove the crushed container.

Further details and advantages of my invention will be apparent upon reading the following detailed description, in conjunction with the drawings.

DETAILED DESCRIPTION OF THE PREFERRED EMBODIMENT

Figure 1:
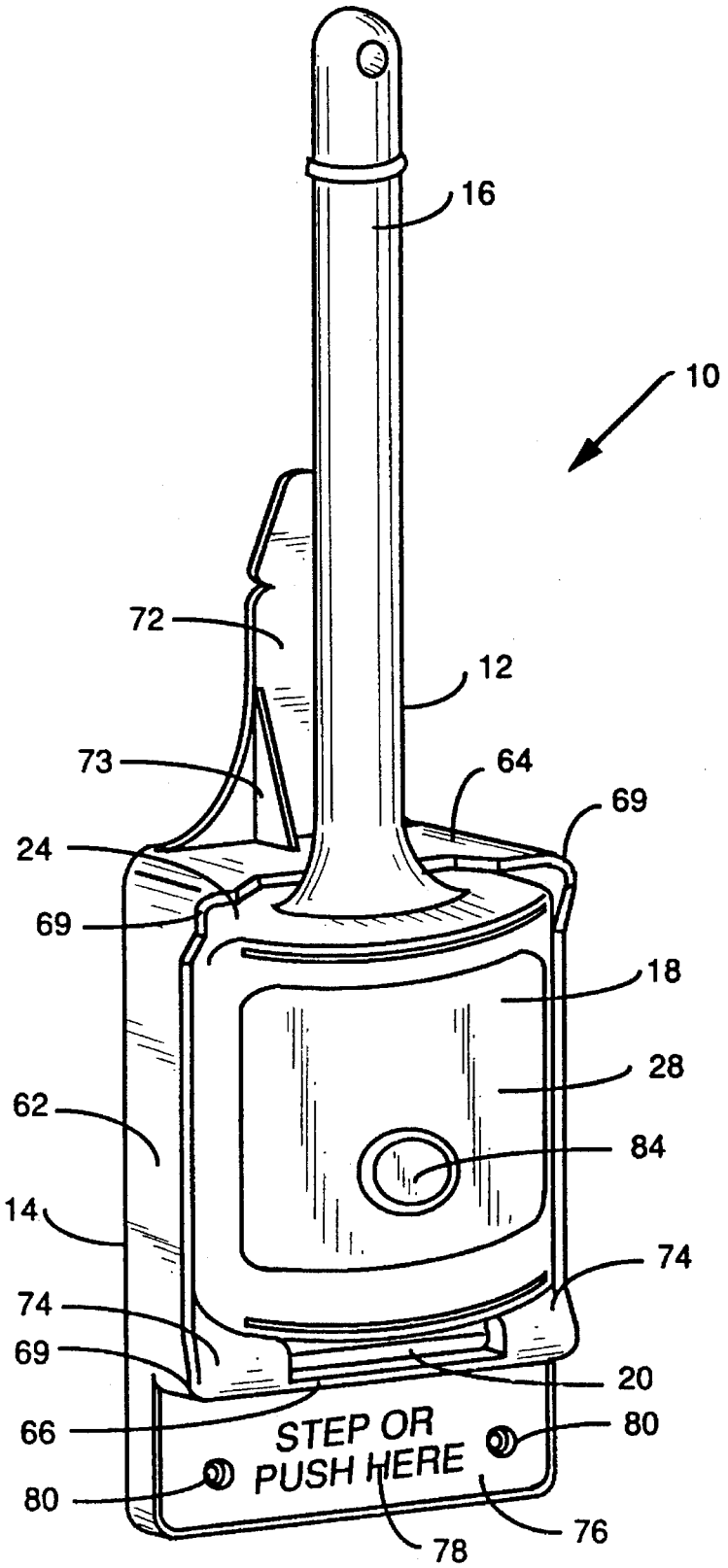
FIG. 1 is a perspective front view of the can crusher of the present invention.
Figure 8:
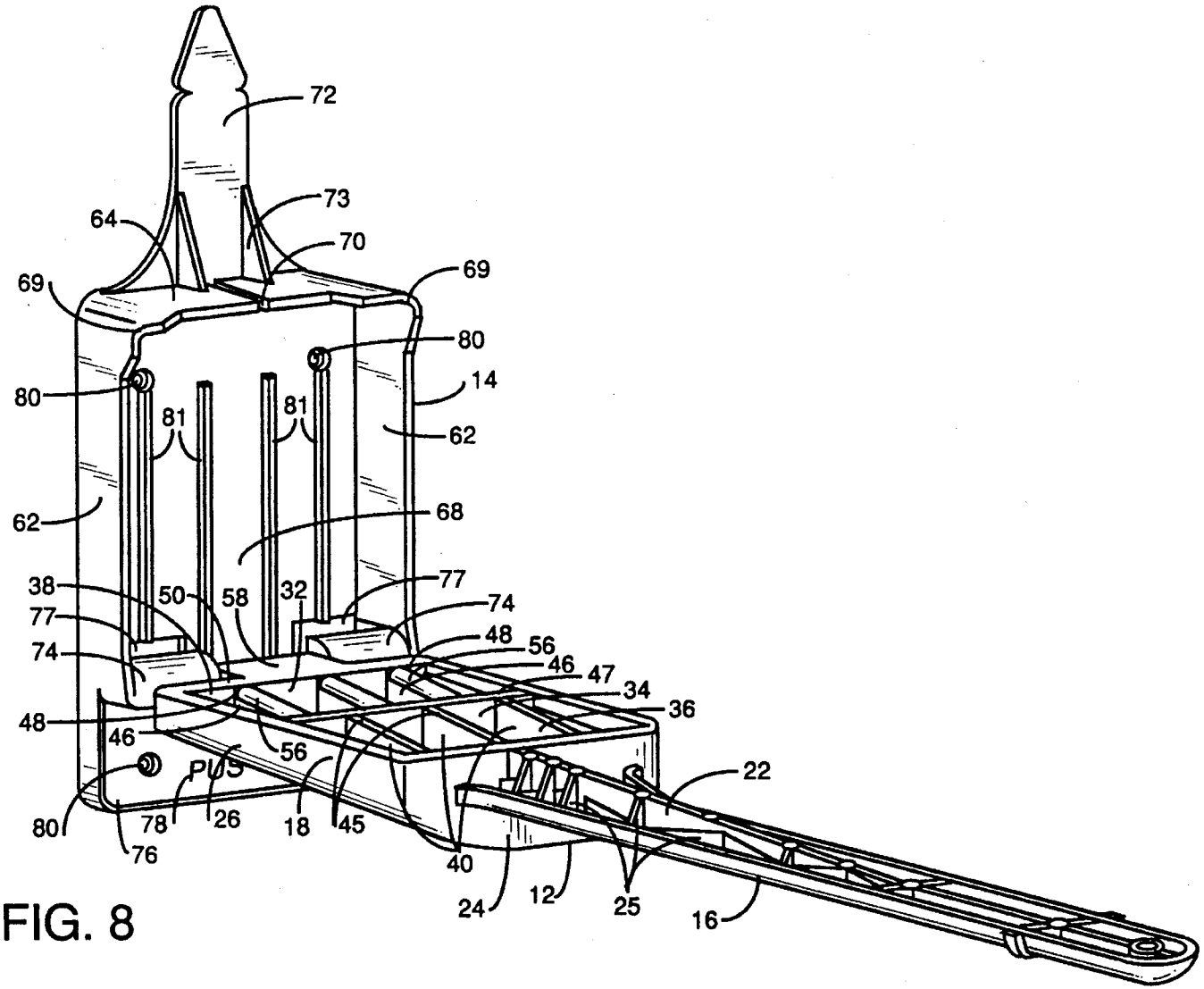
FIG. 8 is a perspective view showing the can crusher of FIG. 1 in an open position.
Figure 9:
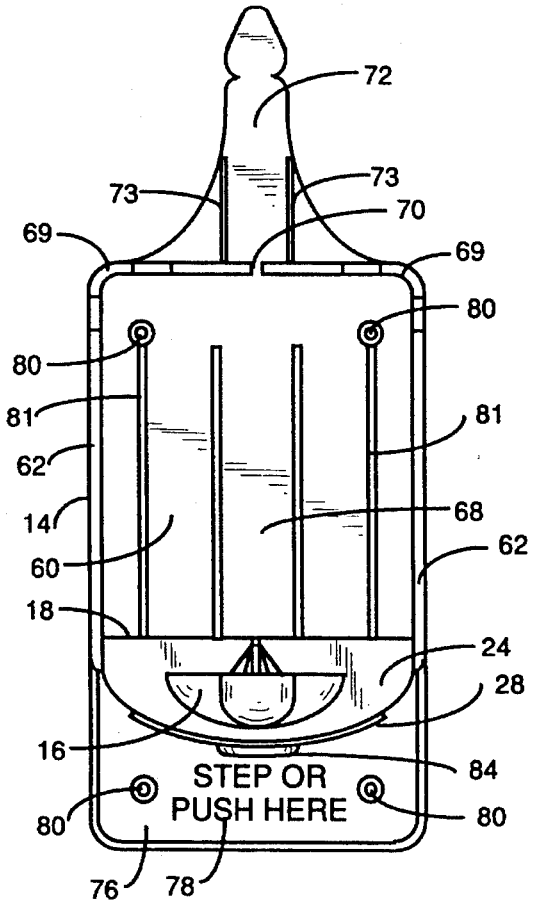
FIG. 9 is a front end view of the can crusher of FIG. 8.
Figure 10:
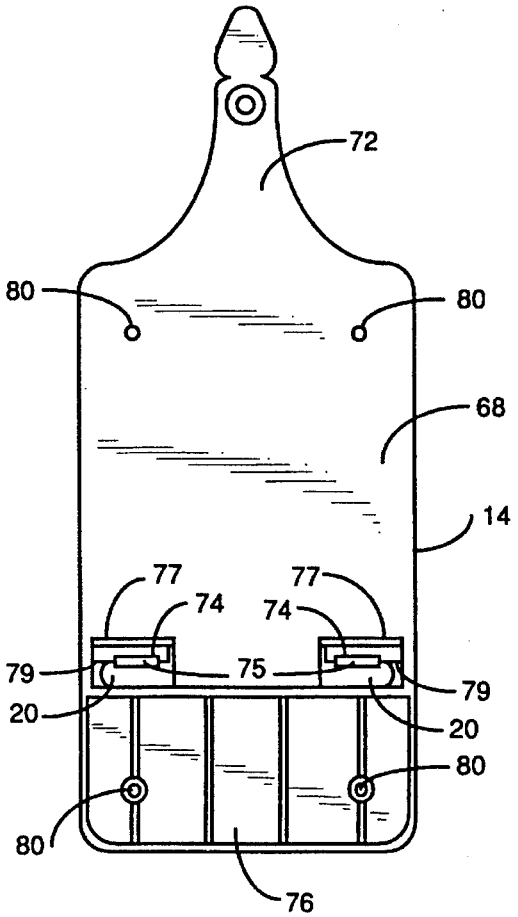
FIG. 10 is a rear end view of the can crusher of FIG. 8.
Figure 11:
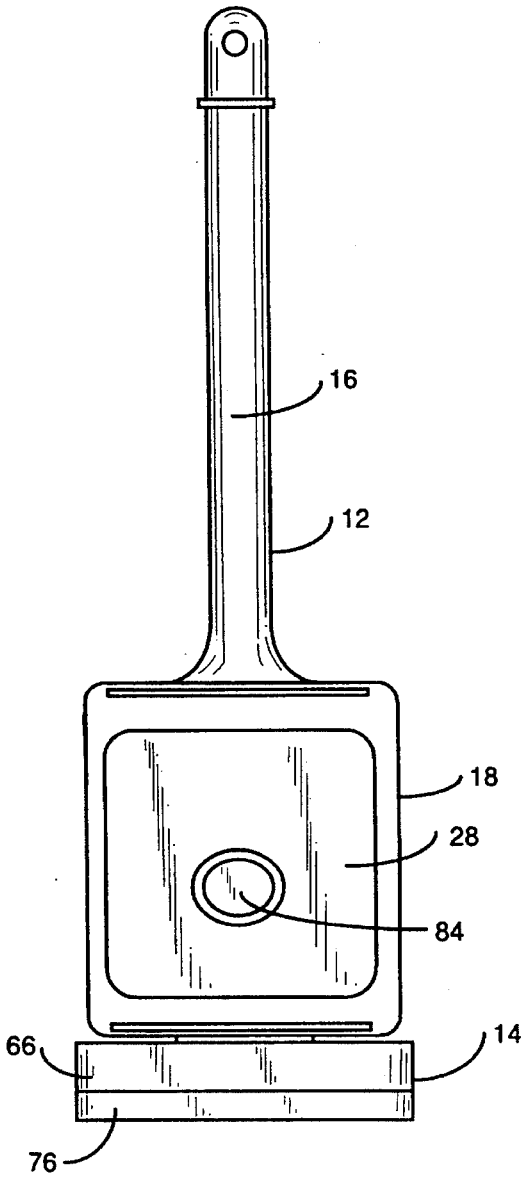
FIG. 11 is a bottom view of the can crusher of FIG. 8.

Can crusher 10 consists of an arm member 12 hingedly connected to a base member 14 as shown in FIGS. 1 and 8. Referring to FIG. 8, arm member 12 is preferably a single piece of molded plastic and includes a semi-cylindrical handle 16, a substantially rectangular crushing portion 18 and a spindle 20. Handle 16 includes a longitudinal stiffening member 22 integrally connected with a first end wall 24 of crushing portion 18, along with a plurality of stiffening webs 25. Crushing portion 18 also includes tapering side walls 26, a semi-circular rear wall 28 (shown in FIG. 11) and a second end wall 32. A bearing wall 34 is located in crushing portion 18 and separates an upper crushing portion 36 from a lower crushing portion 38. Bearing wall 34 is transverse to handle 16. Upper crushing portion 36 includes three struts 40 substantially perpendicular to bearing wall 34 and extending between bearing wall 34 and first end wall 24. The struts extend in the general longitudinal direction of arm member 12. The top surfaces 45 of the struts 40 are coplanar with the top surface 47 of bearing wall 34.

Figure 12:
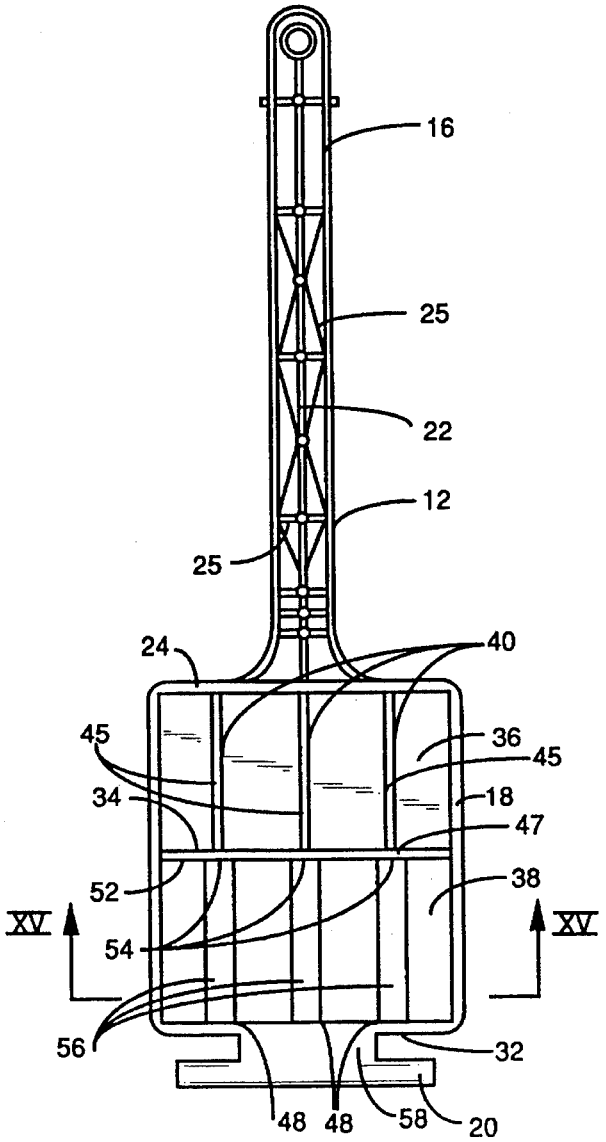
FIG. 12 is a rear elevation view showing a can crusher arm member according to the present invention.
Figure 15:
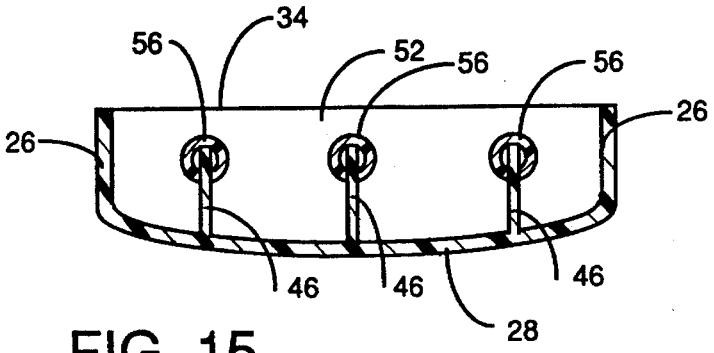
FIG. 15 is a sectional view taken along lines XV—XV of FIG. 12.

Lower crushing portion 38 includes three struts 46 extending between bearing wall 34 and second end wall 32 and parallel to struts 40. The first ends 48 of struts 46 are level with upper surface 50 of end wall 32. Referring to FIGS. 12 and 15, a lip 52 is formed on bearing wall 34 above struts 46 between the second ends 54 of struts 46 and the top surface 47. Struts 46 are preferably provided with semi-circular protective elements 56 removably connected thereto. Particularly, elements 56 may include sections of hard plastic tubing which are slotted to receive struts 46 with an interference fit. The protective elements are generally made from a harder material than the arm member 12 to prevent damage to struts 46 during operation. The protective elements are easily detached from the struts 46 for replacement when worn. Preferably, the protective elements 56 are made from Nylon 66 while the arm member 12 and base member 14 are made from polypropylene copolymer which is softer and more flexible. Spindle 20 is attached to second end wall 32 via lug 58.

Figure 13:
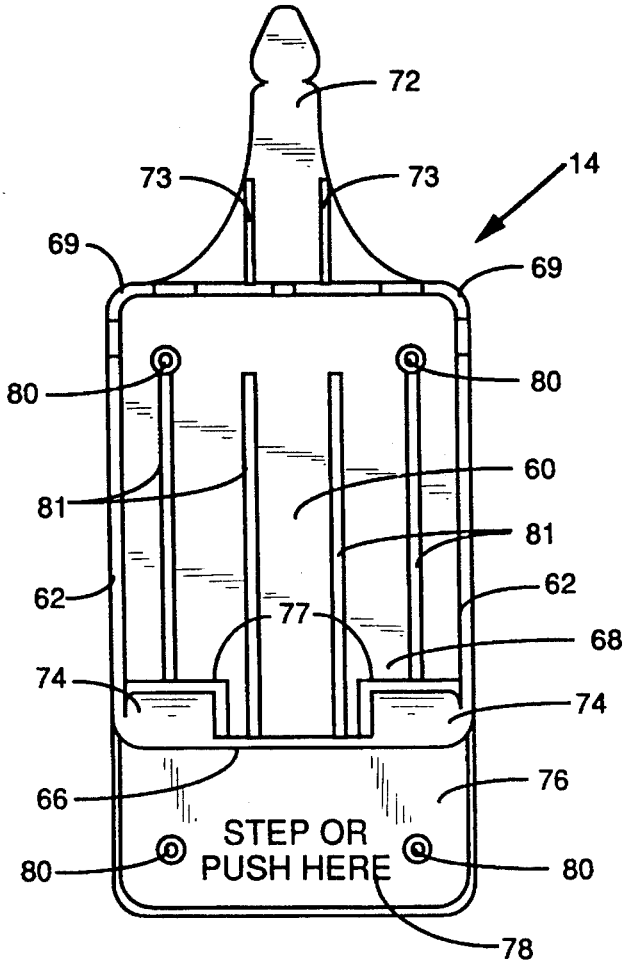
FIG. 13 is a front elevation view showing a can crusher base member according to the present invention.

Referring to FIGS. 8 and 13, base member 14 is preferably a single piece of molded plastic having a can receiving portion 60. Can receiving portion 60 is defined by side walls 62, first end wall 64, second end wall 66 and base wall 68. The corners of walls 62, 64 and 66 are provided with raised shoulders 69. First end wall 64 has a slot 70 disposed therein to receive stiffening member 22 when arm member 12 and base member 14 are in the closed position. Base member 14 receives crushing portion 18 in a nested fashion as shown in FIG. 1. A stabilizer 72 is integrally formed with first end wall 64 and preferably extends approximately 4.25 inches from wall 64. Stabilizer 72 is provided with stiffening webs 73. Second end wall 66 includes a pair of semi-cylindrical journal elements 74 extending downward from shoulders 69 and designed to capture and hingedly hold the ends of spindle 20 with a snap-fit.

Figure 3:
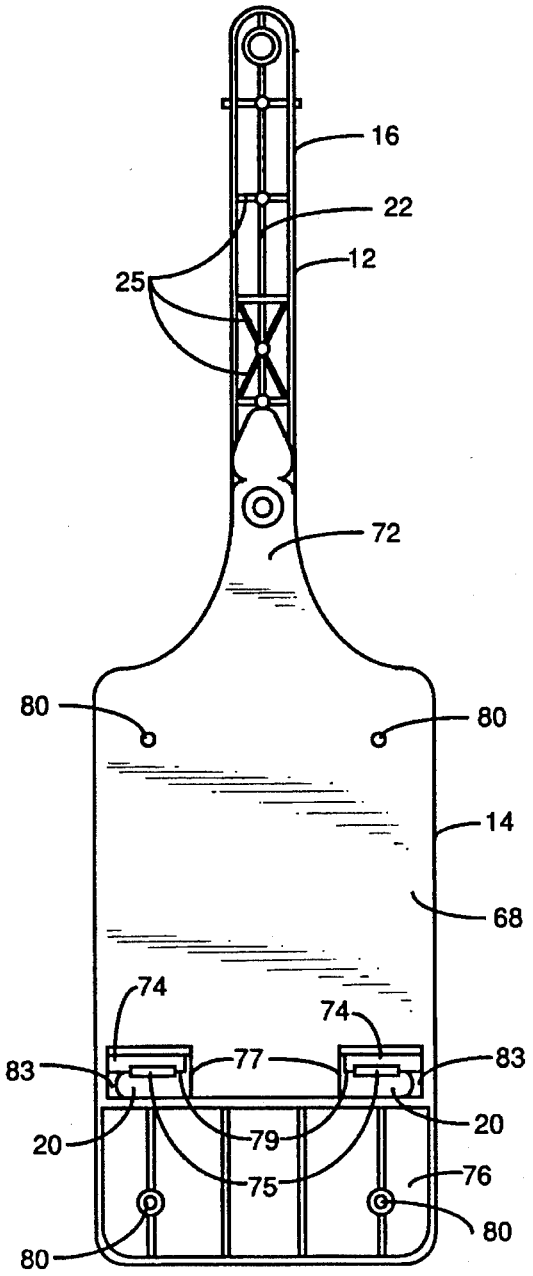
FIG. 3 is a rear view of the can crusher of FIG. 1.
Figure 4:
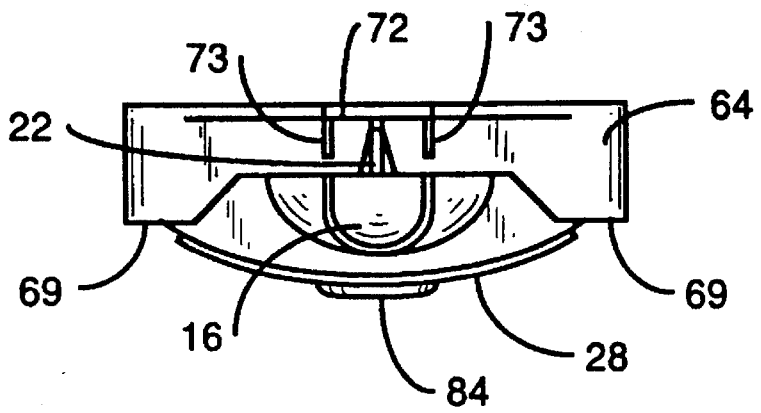
FIG. 4 is a top view of the can crusher of FIG. 1.
Figure 5:
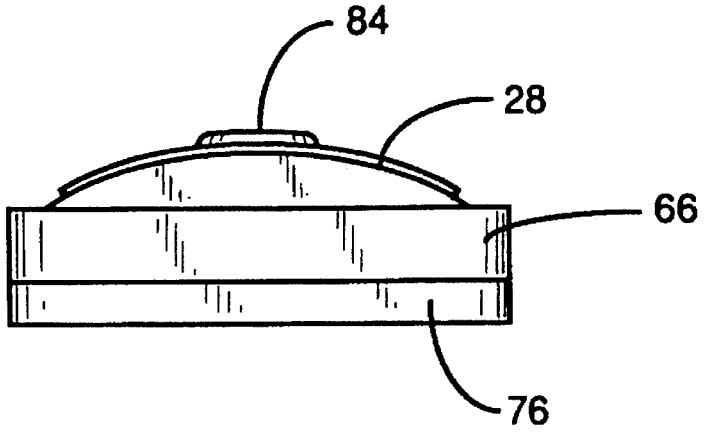
FIG. 5 is a bottom view of the can crusher of FIG. 1.
Figure 6:
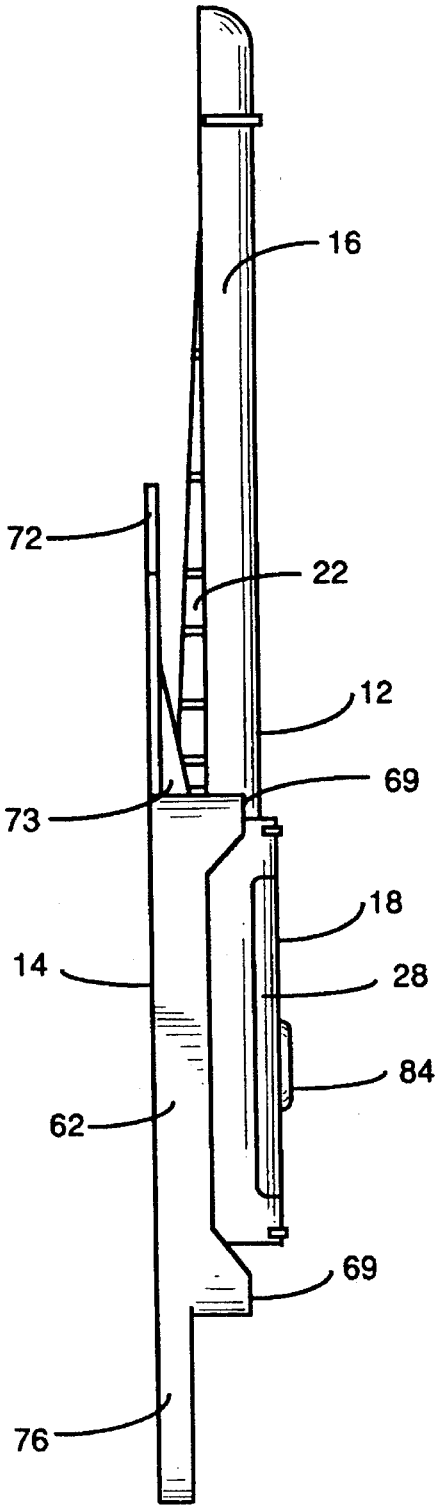
FIG. 6 is a left side view of the can crusher of FIG. 1.
Figure 7:
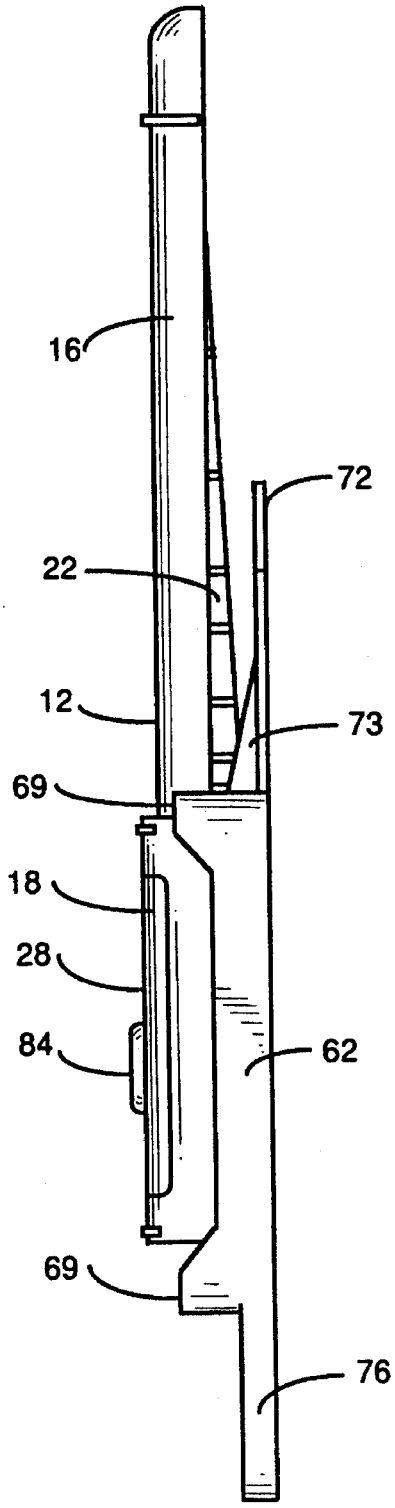
FIG. 7 is a right side view of the can crusher of FIG. 1.

As shown in FIGS. 3 and 8, arm member 12 and base member 14 are hingedly joined by inserting spindle 20 into journal elements 74 such that crushing portion 18 and receiving portion 60 are generally facing one another. Journal elements 74 include snap tabs 75 to ensure spindle 20 remains captive in the journal elements. Spindle 20 is removable from journal elements 74, as discussed below. Snap tabs 75 have a cross section which tapers in the direction of lip 79 on journal elements 74. The snap tabs are centrally located on lips 79 and extend slightly beyond the lips into opening 83. Preferably, the lateral ends of the snap tabs 75 are not coterminous with the lips. Base member 14 is also provided with portals 77 in base wall 68. The portals are aligned with journal elements 74 and enable a user to view the journal elements to ensure the spindle 20 is fully engaged therein. Base wall 68 is equipped with longitudinal raised ribs 81, which provide a skid surface for a can being crushed in the device, preventing marring or deformation of the base wall 68. Finally, base wall 68 has two screw holes 80 for attaching base member 14 to a flat surface, such as a wall or countertop.

Figure 14:
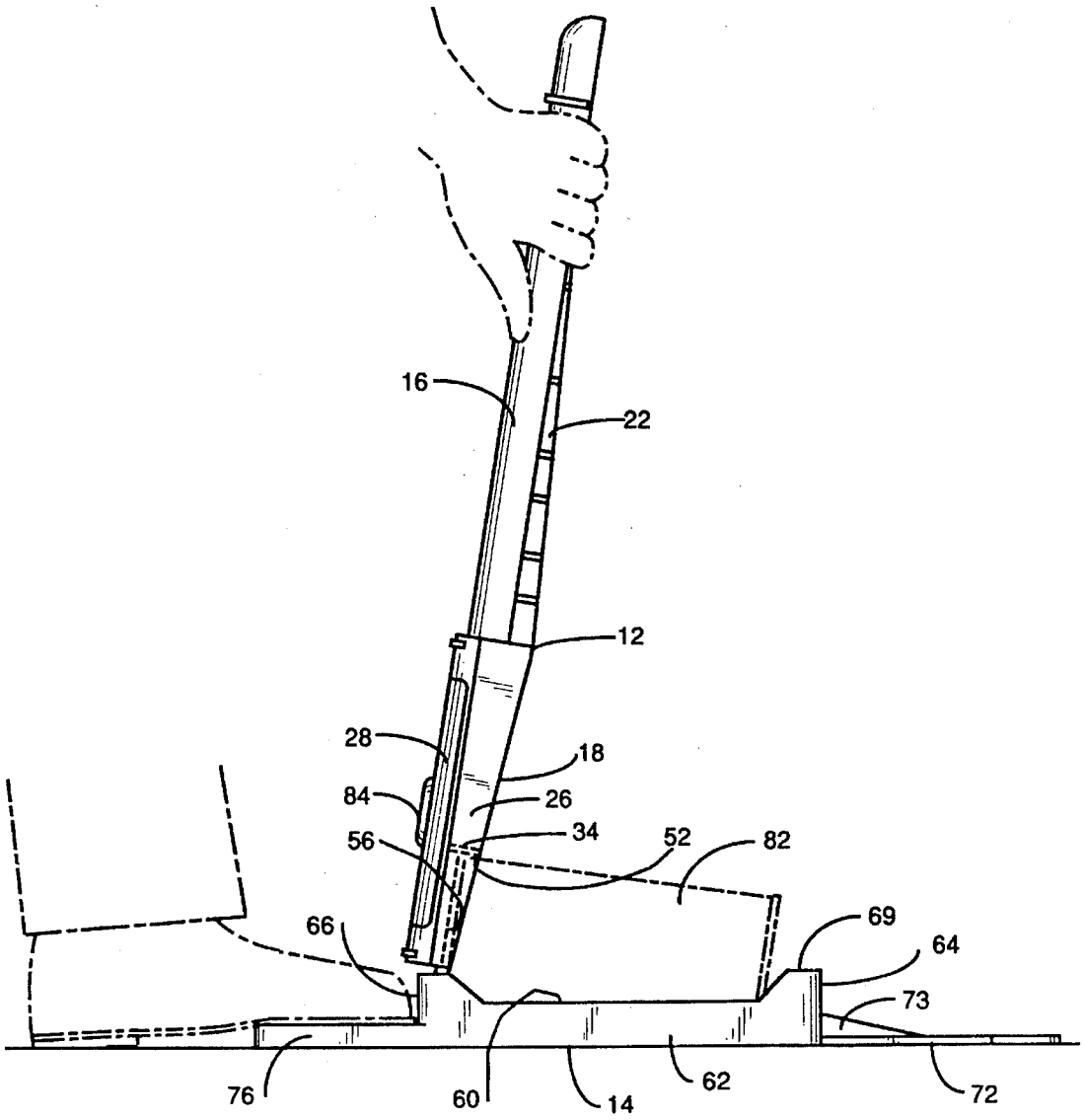
FIG. 14 is a side elevation view showing a can to be crushed as placed between an arm member and a base member of a crushing device according to the present invention.

Can crusher 10 may thus be mounted to a wall or other fixture by screws, or it may remain portable. Importantly, the device should be wall mounted with stabilizer 72 pointed upward to ensure proper operation. To operate the can crusher in the wall-mounted mode, a can 82 is placed lengthwise in can receiving portion 60 as shown in FIG. 14. One end of can 82 is adjacent first end wall 64 and the other end of can 82 is adjacent second end wall 66. Handle 16 is then pivoted toward base member 14 until a rim of the can is engaged by lip 52 on bearing wall 34 so that the can is held in captive fashion between lip 52 and first end wall 64. Thus, can 82 is securely held in the can crusher. The operator then continues pushing handle 16 toward base member 14 with sufficient force to crush the can. The can may then be rotated 180° on end and the above procedure repeated to crush both ends of the can. Because the ends of can 82 are in secure abutment with first wall 64 and lip 52, there is no danger of can 82 slipping out of or "leaping" from the can crusher. It is preferred that lip 52 extend at least ⅛ inch above protective elements 56 to ensure the can is secure and to prevent leaping.

Figure 2:
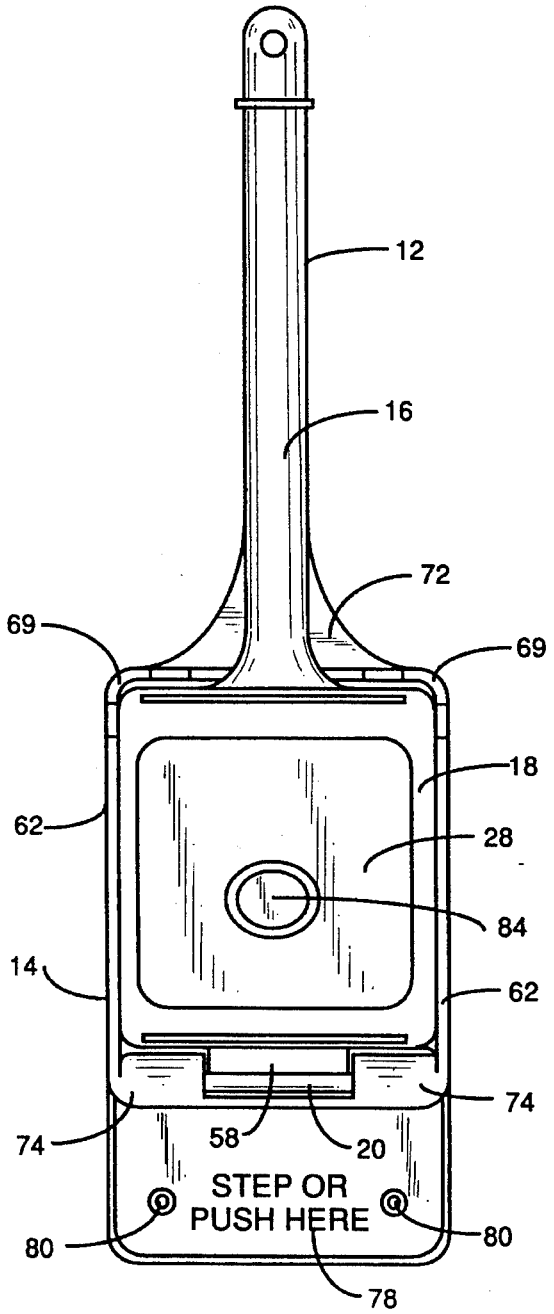
FIG. 2 is a front view of the can crusher of FIG. 1.

Alternatively, the base member may be rested on any flat surface without being fixedly attached thereto. As shown in FIGS. 1, 2 and 14, a step pad 76 is formed adjacent to second end wall 66 and contains indicia of use 78 formed thereon. The step pad allows for portable use of the can crusher 10 since a downward force may be applied to the pad by hand or foot to counter the action of pivoting handle 16 during crushing. I have found the pad 76 should extend at least 1 inch from wall 66 for optimal operation. It is believed the indicia 78 will heighten awareness of the portability of the device and will prevent users from stepping on stabilizer 72 where injury could result from handle 16. Step pad 76 also contains recessed screw holes 80.

To crush a can in the portable mode, an operator places the can lengthwise in can receiving portion 60 as previously described and places a hand or foot on step pad 76 to securely hold base member 14 in place. Then, as previously described, the operator forces handle portion 16 toward base member 14 to crush can 82. Stabilizer 72 prevents any rocking motion of base member 14 which could result from insufficient force applied to step pad 76. Step pad 76 allows the user to exert appropriate leverage against can 82, via handle 16 and crushing portion 18, to fully crush the can.

The can crusher 10 may also include an emblem insert 84 on rear wall 28 of arm member 12. The emblem may be provided blank at the manufacturing stage and later stamped with the name or logo of the particular distributor for the can crusher. It is envisioned the emblem could be provided separately from the can crusher to the distributor, and the distributor can then stamp the emblem with appropriate indicia and insert the emblem on arm member 12 by gluing, fusion welding, riveting or similar means well known in the art. The emblem insert is especially advantageous due to the universal nature of the can crusher and the expected international market therefor. Of course, appropriate stamping and securement might also be carried out by the manufacturer.

Portals 77 may also serve as drain openings in base member 14. Particularly, base member 14 may collect spillage from crushed can contents and it is therefore desirable to periodically rinse base member 14 after use. Rinsing is especially facilitated when the can crusher is in the portable mode. To rinse, the arm member 12 is pivoted to the open position and the base member 14 is placed under a faucet or similar water source. Water engages base wall 68 and may be channeled by ribs 81 toward second end wall 66 by tilting base member 14 appropriately. Water then drains through openings 77, thereby cleaning the base member.

Bearing wall 34 and lip 52 are preferably located at least 3.5 inches above ribs 81, as measured when arm member 12 and base member 14 are at a 90° angle. This is sufficient clearance to engage lip 52 on the rim of aluminum beverage cans, steel cans of common sizes and plastic bottles of common sizes. The varying diameters of these containers are easily accommodated since the crushing portion 18 is pivotable between 0 and approximately 100° with respect to base member 14. For varying sized containers, the crushing portion 18 need only be pivoted accordingly to engage lip 52 on a rim of the container. The can receiving portion 60 preferably measures 5 inches long by approximately 4 ⅜ inches wide.

For large sized containers, such as 16-oz. beverage cans or one (1) liter plastic beverage bottles, it is preferable to first place the container in can receiving portion 60 transversely to the longitudinal axis of handle 16. The middle portions of these containers are then pre-crushed to ensure thorough crushing of the ends of the container as described above, and to further reduce the likelihood of leaping cans. During pre-crushing, shoulders 69 serve to secure the oversized container in can receiving portion 60.

After use, arm member 12 and base member 14 can be easily disassembled for cleaning by closing can crusher 10 as shown in FIG. 1, applying downward pressure to rear wall 28 in the area of emblem insert 84 and releasing spindle 20 from journal elements 74. The separate components may then be placed in a dishwasher and thorough cleaning is assured. The components are reassembled by replacing crushing portion 18 in nested engagement with receiving portion 60 and aligning spindle 20 with journal elements 74. The user then pushes downward on handle 16, forcing stiffening rib 22 against the bottom of slot 70. The resulting lever action forces spindle 20 upward past snap tabs 75 and into engagement with journal elements 74.

While a preferred embodiment of the invention has been described in detail herein, it will be appreciated by those skilled in the art that various modifications and alternatives to the preferred embodiment could be developed in light of the overall teachings of the disclosure. Accordingly, the particular arrangement is illustrative only and is not limiting as to the scope of the invention which is to be given the full breadth of the appended claims and any and all equivalents thereof.

I claim:

1. A device for crushing containers, comprising:

a base member having a pair of side walls, a first end wall, a second end wall and a base wall, said walls defining a container receiving portion, said second end wall having a journal element spaced from said base wall;

a removable arm member hingedly connected to said base member, said arm member having a handle, a crushing portion and a spindle, said spindle received in said journal element on said base member so that said crushing portion faces said container receiving portion and said crushing portion may engage said container receiving portion in nested fashion;

a step pad extending from said second end wall on said base member;

said arm member crushing portion having a bearing wall separating an upper crushing portion and a lower crushing portion, said lower crushing portion having a plurality of struts perpendicular to said bearing wall and extending in the general longitudinal direction of said arm member, each strut having a first end adjacent said spindle and a second end adjacent said bearing wall, said bearing wall having a lip extending above the second ends of said struts;

said lip defining means for capturing a container between said arm member and said base member without ejecting said container so that the container is crushed when the crushing portion of said arm member is engaged in the container receiving portion of said base member.

2. The device of claim 1 including a protective element on at least one of said struts, said protective element positioned between the first and second ends of said strut.

3. The device of claim 1 wherein said journal element has a lip defining an opening between said lip and said second end wall and including a snap tab on said lip, said snap tab and said lip defining means for removably engaging said spindle and said journal element with a snap-fit.

4. The device of claim 1 including use-instructive indicia on said step pad.

5. The device of claim 1 including means for securing said base member to a flat surface.

6. The device of claim 1 including an emblem insert on said arm member.

7. The device of claim 1 including a stabilizer extending from the first end wall of said base member.

8. The device of claim 1 including a plurality of raised ribs on said base member base wall.

9. The device of claim 1 including at least one drain opening in said base member for adding in rinsing the base member after use.

10. A device for crushing containers, comprising:

a base member having a pair of side walls, a first end wall, a second end wall and a base wall, said walls defining a container receiving portion, said second end wall having a journal element spaced from said base wall;

a removable arm member hingedly connected to said base member, said arm member having a handle, a crushing portion and a spindle, said spindle received in said journal element on said base member so that said crushing portion faces said container receiving portion and said crushing portion may engage said container receiving portion in nested fashion;

a step pad extending from said second end wall on said base member;

said arm member crushing portion having a bearing wall separating an upper crushing portion and a lower crushing portion, said lower crushing portion having a plurality of struts perpendicular to said bearing wall and extending in the general longitudinal direction of said arm member, each strut having a first end adjacent said spindle and a second end adjacent said bearing wall, said bearing wall having a lip extending above the second ends of said struts;

a protective element on at least one of said struts and positioned between the first and second ends of said strut;

said lip defining means for capturing a container between said arm member and said base member without ejecting said container so that the container is crushed when the crushing portion of said arm member is engaged in the container receiving portion of said base member.

11. The device of claim 10 wherein said journal element has a lip defining an opening between said lip and said second end wall and including a snap tab on said lip, said snap tab and said lip defining means for removably engaging said spindle and said journal element with a snap-fit.

12. The device of claim 10 including use-instructive indicia on said step pad.

13. The device of claim 10 including means for securing said base member to a flat surface.

14. The device of claim 10 including an emblem insert on said arm member.

15. The device of claim 10 including a stabilizer extending from the first end wall of said base member.

16. The device of claim 10 including a plurality of raised ribs on said base member base wall.

17. The device of claim 10 including at least one drain opening in said base member for adding in rinsing the base member after use.

18. A method for crushing a container having a first end and a second end with a rim on said second end, in a device having an arm member hingedly connected to a base member, said arm member having a crushing portion and a handle, said crushing portion having a bearing wall and a plurality of struts perpendicular to said bearing wall, said bearing wall having a lip extending above said struts, said base member having a receiving portion defined by a first end wall, a second end wall, a base wall and two side walls, said base member further having a step pad extending from said second end wall, said arm member hingedly connected to said base member at said second end wall, said method comprising the steps of:

(1) placing said base member on a flat surface;

(2) pivoting said arm member so that said arm member is disposed at an angle with respect to said base member, said angle large enough to provide clearance between said arm member and said base member for a container to be crushed;

(3) placing said container in said receiving portion so that the second end of the container is adjacent said second end wall of said base member;

(4) applying pressure to said step pad by stepping with a foot or pressing with a hand;

(5) pivoting said arm member to engage the rim of said container on the lip of said bearing wall;

(6) further pivoting said arm member in the direction of said base member to engage said crushing portion in said receiving portion in nested fashion and crush the container; and (7) pivoting said arm member out of nested engagement with said base member to remove the crushed container.

* * * * *

UNITED STATES PATENT AND TRADEMARK OFFICE

CERTIFICATE OF CORRECTION

PATENT NO. : 5,507,222

DATED : April 16, 1996

INVENTOR(S) : Oliver M. Reavey

It is certified that error appears in the above-indentified patent and that said Letters Patent is hereby corrected as shown below:

Title page, item '[56] References Cited, U.S. PATENT DOCUMENTS', insert the following:

--5,009,155 4/1991 Christianson ... 100/233
5,038,677 9/1991 Wittman et al. ... 100/137
5,138,941 8/1992 Strauss ... 100/53
5,158,013 10/1992 Morris ... 100/45
5,188,024 2/1993 Li ... 100/274
5,265,530 11/1993 Perhacs et al. ... 100/233
5,293,816 3/1994 Musumeci, Sr. et al. ... 100/245--.

Title page, item '[56] References Cited, FOREIGN PATENT DOCUMENTS', insert the following:

--2,007,253 10/1990 United Kingdom.--.

Title page, item '[56] References Cited' after FOREIGN PATENT DOCUMENTS' information, insert the following:

--OTHER PUBLICATIONS
Photocopies of product label for "Can Crusher", distributed by Eurochef Asia in 1991.--.

Claim 9 Line 25 Column 7 "adding" should read --aiding--.

Claim 17 Line 19 Column 8 "adding" should read --aiding--.

Signed and Sealed this

Twentieth Day of August, 1996

*Attest:*

Bruce Lehman

BRUCE LEHMAN

*Attesting Officer*

*Commissioner of Patents and Trademarks*